US006118090A

United States Patent [19]

Osvatic et al.

[11] Patent Number: 6,118,090

[45] Date of Patent: Sep. 12, 2000

[54] SELF-ALIGNING LID SWITCH FOR LAUNDRY MACHINES

[75] Inventors: Michael Osvatic; David M. Howie; Michael Hintz, all of Waukesha, Wis.

[73] Assignee: U.S. Controls Corporation, New Berlin, Wis.

[21] Appl. No.: 09/468,276

[22] Filed: Dec. 20, 1999

[51] Int. Cl.[7] ..... H01H 3/16

[52] U.S. Cl. ..... 200/61.76

[58] Field of Search ..... 200/16 R, 6 R, 200/16 B, 17 R, 61.41, 61.42, 61.62, 61.7, 61.73, 61.74, 61.76, 61.81, 61.82, 286, 287, 329, 341, 345, 501

[56] References Cited

U.S. PATENT DOCUMENTS 5,389,756 2/1995 Micallef ..... 200/345
5,826,709 10/1998 Jacob ..... 200/345
5,941,374 8/1999 Hapke et al. ..... 200/345
5,947,268 9/1999 Lange et al. ..... 200/345

*Primary Examiner*—Michael Friedhofer
*Attorney, Agent, or Firm*—Quarles & Brady

[57] ABSTRACT

A self-adjusting lid switch for a laundry apparatus provides a switch assembly attached to the housing of the machine and an actuator arm attached to the lid. The actuator arm includes an actuating surface pressing an operator of the switch assembly when the lid is sufficiently closed to allow operation of the machine. Problems of manufacturing tolerance and wear that might displace the actuator arm and switch assembly are accommodated by providing each of the actuator arm and switch assembly with alignment surfaces that upon closing of the lid, align the respective components prior to actuation of the switch. The alignment surfaces may be pins extending from the actuator arm received by a corresponding funnel-shaped channel between fingers flanking the operator of the switch that receive the pins.

8 Claims, 3 Drawing Sheets

SELF-ALIGNING LID SWITCH FOR LAUNDRY MACHINES

FIELD OF THE INVENTION

The present invention relates to laundry machines, and specifically to a switch for stopping the spin cycle of a clothes washing machine or the like when the lid is raised.

BACKGROUND OF THE INVENTION

During the spin cycle of the washing machine, when water is removed from wet clothes centrifugally by spinning the clothes in a spin basket, it is important that the washing machine lid remains closed to prevent injury to the user. For this reason, the lid is normally connected to an electrical switch which controls a mechanism to stop the motion of the spin basket when the lid is raised.

For reasons of manufacturing convenience and to reduce the possibility of the switch being defeated, it may be desirable to place the lid switch near the lid hinge. At this position, however, there is very little motion of the lid when the lid is opened. As a result, the lid switch must be carefully adjusted during manufacturing to ensure that the spin basket is stopped before the lid is opened too far. This adjustment may be accomplished, for example, by mounting the lid switch to a slide adjustment bracket, which is manually located and tightened into position with one or more screws. This adjustment process increases the cost of manufacturing the washing machine and creates the potential for future misadjustment if the screws become loosened.

One method of providing a rear-mounted lid switch that may accurately operate with small openings of the lid without the need for manual adjustment is through the use of a self-adjusting link positioned between the electrical contacts of the switch and the lid. The self-adjusting link is compressed or otherwise deformed upon the first closing of the lid to precisely fix the relationship between the actuation of the electrical contacts and movement of the lid. Several such self-adjusting links are disclosed in U.S. Pat. Nos. 5,600,976, 5,682,772, 5,691,520 and 5,728,985 assigned to the assignee of the present invention and hereby incorporated by reference.

By providing for automatic adjustment of the switch actuation point, these designs all allow simpler assembly of the laundry machine by eliminating the need for time consuming manual adjustment.

SUMMARY OF THE INVENTION

The present invention is a lid switch for laundry machines that provides many of the same benefits of the self-adjusting link designs referred to above. In contrast to those designs, however, the present invention uses engaging alignment surfaces on the switch assembly and the actuation portion of the lid, to adjust the separation between these two elements just prior to activation of the switch. By eliminating the need for a self-adjusting link element, the switch design is simplified, and because the adjustment process is repeated with each closing of the lid, if necessary, the present design may accommodate wear or shifting in the relationship between the switch assembly and the activation portion of the lid over the lifetime of the laundry equipment.

Specifically, the present invention provides a switch for a laundry machine having a lid moving between an open and closed position with respect to a housing. The switch includes a switch assembly supported by the housing and having a pair of electrical contacts for actuation by an operator moving along an actuation direction. An actuator communicating with the lid to move therewith has an actuator surface pressing the operator inward in the actuation direction when the lid moves from an open to a closed position to actuate the pair of electrical contacts. Either or both the switch assembly and the actuator are mounted for movement along the actuation direction with respect to the housing and lid, respectively, and each includes engaging alignment surfaces adjusting the relative position of the switch assembly and the actuator along the actuation direction prior to actuation of the operator by the actuator surface.

Thus, it is one object of the invention to ensure a proper actuation of the lid switch with small motions of the lid by enlisting the actuator itself to align the switch prior to the actuation of the switch.

The switch assembly may include tabs engaging edges of a slot extending along the actuation direction in the housing, the slot being oversized along the actuation direction to allow sliding of the switch assembly with respect to the housing along the actuation direction.

Thus, it is another object of the invention to provide an extremely simple switch assembly wherein the mounting to the housing provides an essential component of the automatic adjustment of the switch.

The lid may pivot about an axis and the alignment surfaces on the switch assembly may include circumferentially extending fingers engaging axially extending pins on the actuator. At least two circumferentially extending fingers may be separated radially to receive a pin therebetween.

Thus, it is another object of the invention to allow the alignment surfaces to align the switch assembly and actuator in either of two directions so as to accommodate both over and under adjustment.

The actuator surface and the alignment surface on the switch assembly may be outwardly opposed.

Thus, it is another objection of the invention to allow the force of actuation of the switch to be opposed by the force between the alignment surfaces, thus preventing a net directional force on either of the actuator or the switch assembly or their supporting housings and lid.

When the lid pivots about an axis and the alignment surfaces of the switch assembly are circumferentially extending fingers, the fingers may extend downward from a portion of the switch assembly abutting the underside of the top surface of the housing when the switch assembly is in position within a slot in the housing.

Thus, it is another object of the invention to allow free movement of the switch assembly along the actuation direction, but to provide it with adequate support against circumferential forces by the actuator.

The foregoing and other objects and advantages of the invention will appear from the following description. In this description, reference is made to the accompanying drawings which form a part hereof and in which there is shown by way of illustration, the preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
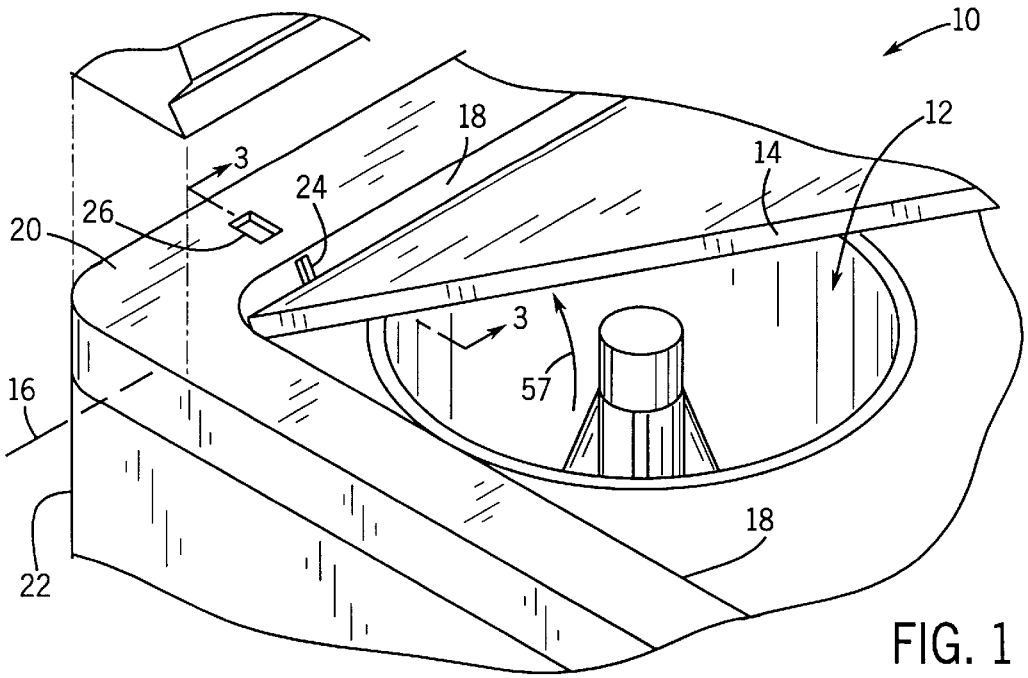
FIG. 1 is a fragmentary, partially-exploded, perspective view of the left-hand rear corner of a standard domestic washing machine showing the lid partially opened to reveal an access channel for an actuator and a mounting slot for a switch assembly, according to the present invention.
Figure 2:
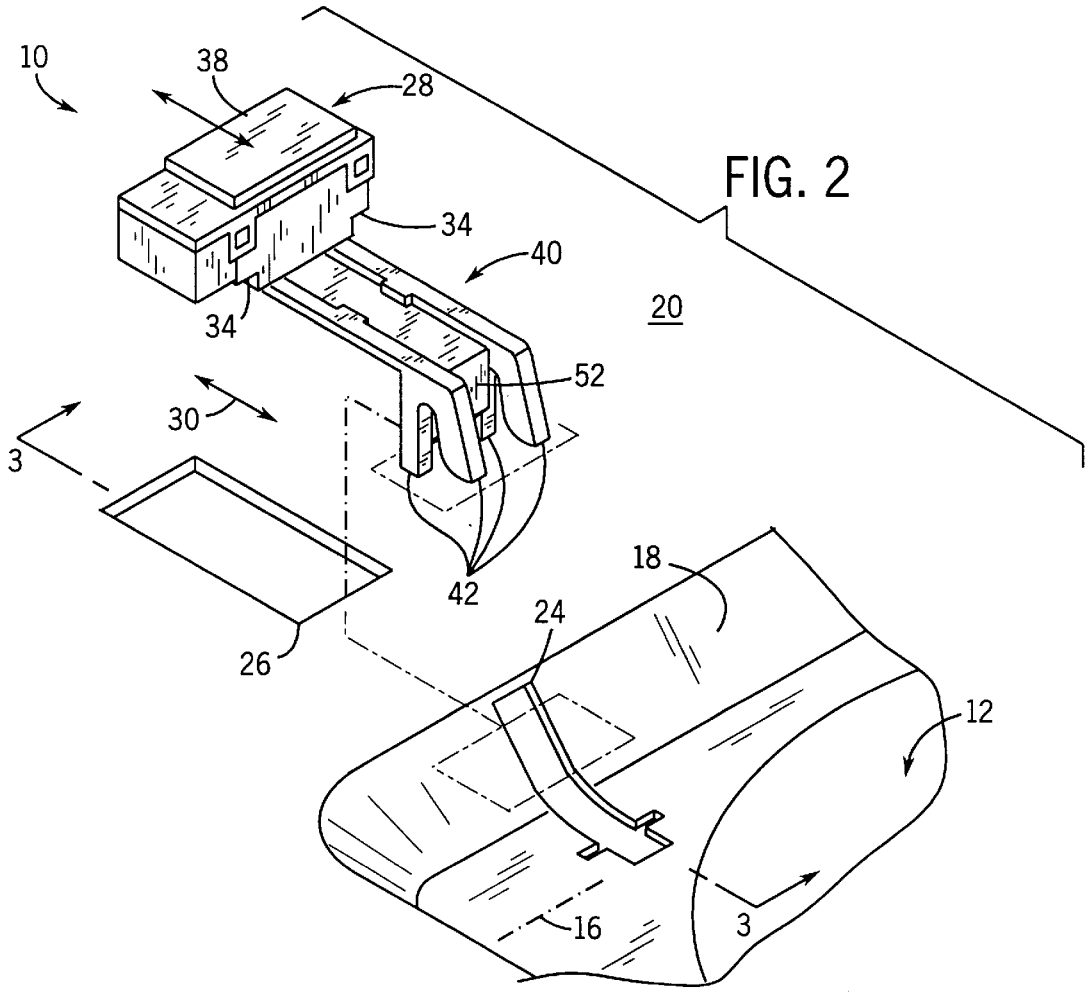
FIG. 2 is a detailed view of the mounting slot of FIG. 1 showing the switch assembly prior to insertion into the mounting slot and showing the ultimate position of alignment surfaces of the switch assembly when the switch assembly is assembled to the slot.

Referring now to FIGS. 1 and 2, a washing machine 10 includes a spin tub 12 having a lid 14 which may open and close to provide access or prevent access respectively to the spin tub. The lid 14 is hinged at its rear surface about pivot axis 16 and may be set within a shallow well 18 so that when closed, it lies substantially flush with an upper surface 20 of the housing 22 of the washing machine 10. The rear wall of the well 18 may include an access channel 24 through which an actuator (to be described) may extend with one end attached to a rear edge of the lid 14 and the other end extending through the access channel 24 to beneath the upper surface 20. Rearward from the access channel 24 in the upper surface 20 is a mounting slot 26 as will receive a switch assembly 28.

Figure 3:
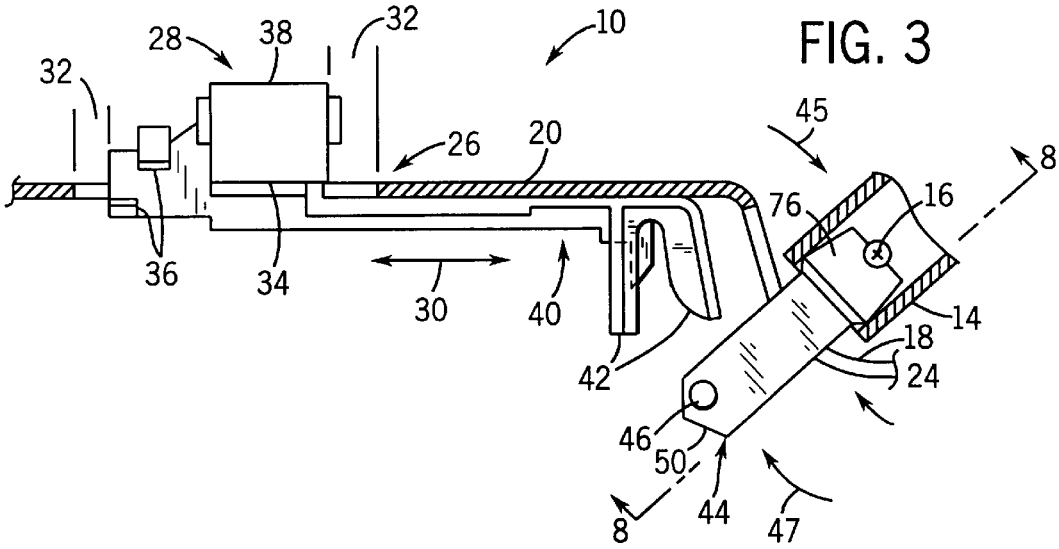
FIG. 3 is a cross-sectional view taken along lines 3—3 of FIGS. 1 and 2, with the switch assembly inserted in the mounting slot in the housing showing a positioning of the switch assembly prior to engagement of its alignment surfaces with alignment surfaces of an actuator attached to the lid and extending through the access channel shown in FIGS. 1 and 2.

Referring now to FIGS. 2 and 3, mounting slot 26 is generally rectangular, its one dimension extending along an actuation direction 30 being oversized 32 so that when switch assembly 28 is inserted into the mounting slot 26, the switch assembly 28 may slide along actuation direction 30 by the amount of an oversizing 32 of the slot 26 with respect to the switch assembly 28. The switch assembly 28 is supported against the upper surface 20 at the edges of the mounting slot 26, on one set of flanges 34, and is held within slot 26 by two of four opposed tabs 36 engaging the edges of the mounting slot 26 extending along the actuation direction 30. As so supported, a contact housing 38 of the switch assembly 28 is positioned above the upper surface 20 of the washing machine 10 and an operator assembly 40 is positioned beneath the upper surface 20.

The end of the operator assembly 40 removed from the contact housing 38 abuts the underside of the upper surface 20 of the housing 22 and holds alignment fingers 42 extending downward and generally in a circumferential direction with respect to a pivot axis 16 about which the lid 14 pivots. The fingers 42 are separated in a radial direction with respect to the pivot axis 16 and create between them a channel which narrows as one moves upward.

Figure 4:
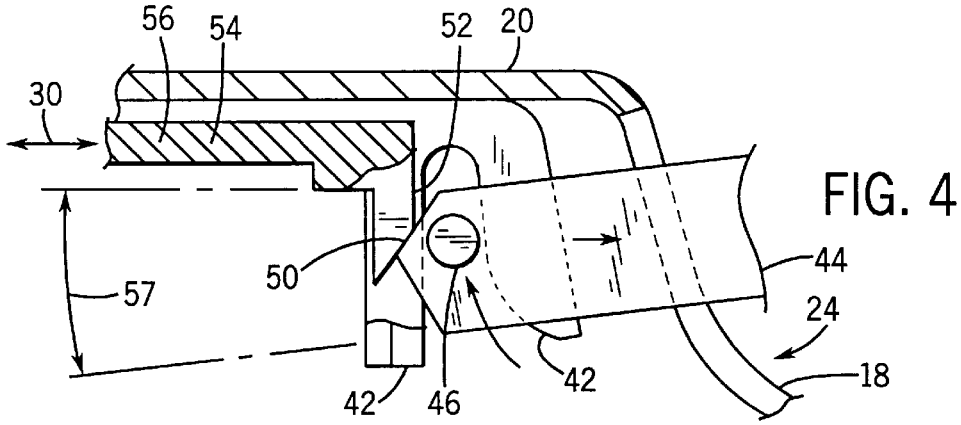
FIG. 4 is a detailed cross-sectional view similar to that of FIG. 3 with the lid further closed showing engagement of the alignment surfaces of the switch assembly and actuator and the abutting of a camming surface of the actuator against an operator of the switch.

Referring now to FIGS. 3 and 4, an actuator arm 44 extends from the rear edge of the lid 14 through the access channel 24 to beneath the upper surface 20 in the vicinity of the fingers 42. Pivoting of the lid 14 about pivot axis 16 is shown by arrow 45, causing a pivoting shown by arrow 47 of the actuator arm 44 upward. The actuator arm 44 extends generally parallel to the surface of the lid 14 rearward from the pivot axis 16.

Pins 46 extending axially (i.e., parallel to pivot axis 16) from either side of the actuator arm 44 are received within the channel created by the fingers 42 as the lid 14 is closed. The upward narrowing of the channel between fingers 42 serves to ensure that the pins 46 will be engaged by the channel as the lid 14 is closed, for the full range of motion of the switch assembly 28 along actuation direction 30.

The narrowing of the channel also serves to ensure that when the lid 14 is fully closed, the switch assembly 28 will have moved along actuation direction 30 to a single location determined by the actuator arm's engagement.

Figure 5:
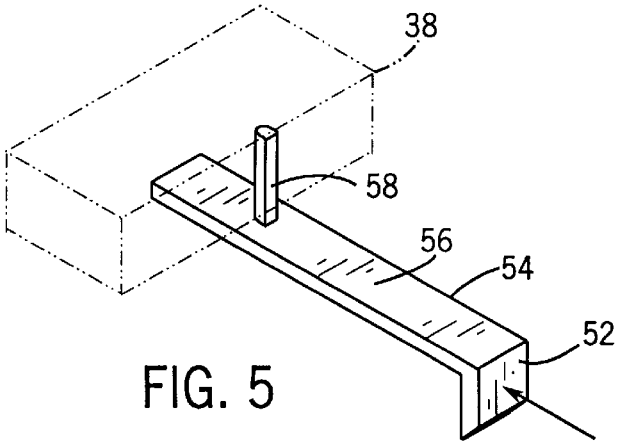
FIG. 5 is a perspective view of the operator of FIG. 4 removed from the other elements of the switch assembly showing the location of a contact assembly in phantom.

When actuator arm 44 pivots upward, as indicated by arrow 47, and pins 46 are received within the channel formed by fingers 42, a camming surface 50 formed from the radially outward edge of the actuator arm 44 engages an opposed operator surface 52 of an operator 54 positioned within the channel formed by fingers 42. The operator 54 has an extension portion 56 extending along actuation direction 30 and slideably received within the operator assembly 40. Referring also to FIG. 5, as the actuator arm 44 moves upward with the closing of the lid 14, the camming surface 50 pushes the operator surface 52 inward along the actuation direction 30. The force of this actuation is countered by the force between the pins 46 and the front most fingers 42 so that there is no net force on the switch assembly 28 or the actuator arm 44 along actuation direction 30.

The camming surface 50 is shaped so that for angles of opening 57 of the lid 14 less than the desired point at which a switching of the contacts of the switch assembly 28 should occur, the operator surface 52 is depressed sufficiently to cause closing of the contacts, but when the lid 14 is open more than this amount, the operator surface is released sufficiently to ensure the contacts have opened. The shape of the cam surface 50 thus allows complete control both of the point at which the operator surface 52 is fully depressed and of the permissible overtravel after that point in the motion of the actuator arm 44 upward into the channel formed by fingers 42. The operation of the pins 46 engaging the fingers 42 eliminates variation in the relative spacing between the switch assembly 28 and actuator arm 44 along actuation direction 30 and, for this reason, the activation point of the switch assembly 28 with respect to angular positions of the lid 14 may be precisely fixed with reasonable manufacturing tolerances.

Figure 6:
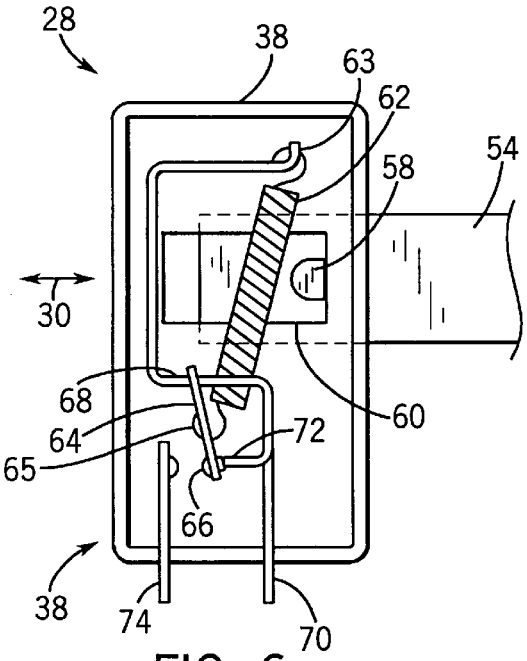
FIG. 6 is a top plan view of the contact assembly of FIG. 5 with the upper portion of the housing removed to reveal the contacts prior to actuation of the operator by the camming surface as shown in FIG. 4.

Referring again to FIG. 5, the extension portion 56 of the operator 54 passes beneath the contact housing 38 and a vertically extending pillar 58 communicates motion of the operator 54 upward into the contact housing 38. Referring also to FIG. 6, the pillar 58 extends into the contact housing 38 through a slot 60 allowing travel of the pillar 58 along the actuation direction 30. Within the contact housing 38, the pillar 58 abuts the approximate middle of a helical tension spring 62 extending generally perpendicular to the actuation direction 30. One end of the helical tension spring 62 is fixed with respect to the contact housing 38 at attachment point 63 and the other end attaches at point 65 to the approximate center of a contact lever 64. The contact lever 64 has a contact 66 on its free end and pivots about a pivot point 68 electrically connected to one terminal 70 of the switch assembly 28. Pivot point 68 is generally positioned so as to be substantially between the attachment points 63 and 65 of the lever 64.

Figure 7:
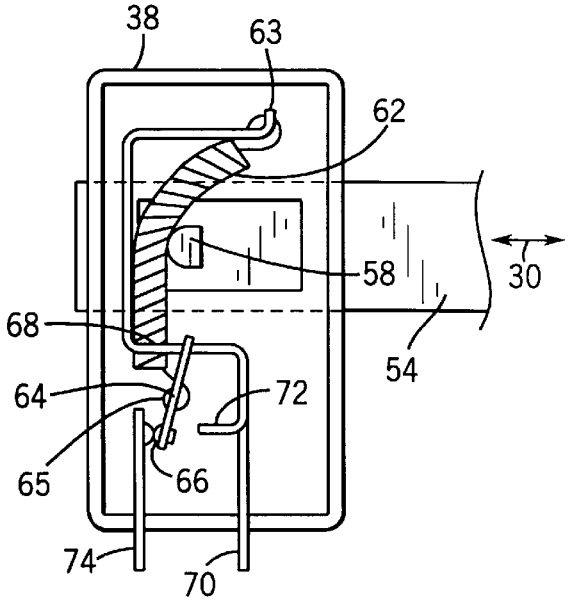
FIG. 7 is a figure similar to that of FIG. 6 showing the contact assembly after actuation.

Prior to actuation of the operator 54, the spring 62 pulls the contact lever 64 backward against a stop 72 and away from a second contact on second terminal 74 thus preventing electrical continuity between terminal 74 and 70. Referring to FIG. 7, when the operator 54 is moved inward along actuation direction 30, pillar 58 presses spring 62 so that the line of tension it exerts on lever 64 crosses pivot point 68 causing the lever 64 to move toward the contact on terminal 74 completing the circuit between terminals 74 and 70.

Figure 8:
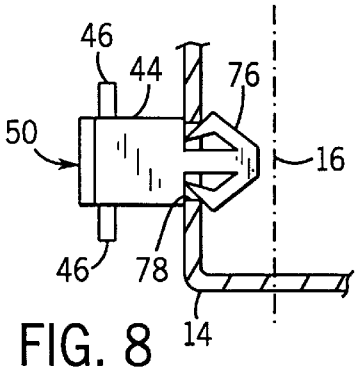
FIG. 8 is a cross-sectional view taken along cut plane 8—8 of FIG. 3 showing attachment of the actuator to the lid.

Referring now to FIG. 8, the actuator arm 44 may be molded as a single plastic part having a wedge-shaped plug 76 with expandable ears so as to lock the actuator arm 44 into a hole 78 cut in the rear surface of the lid 14. The expanding ears pull the actuator arm 44 to abut the rear surface of the lid 14 and the hole 78 may be rectangular to prevent twisting between the two components.

Figure 9:
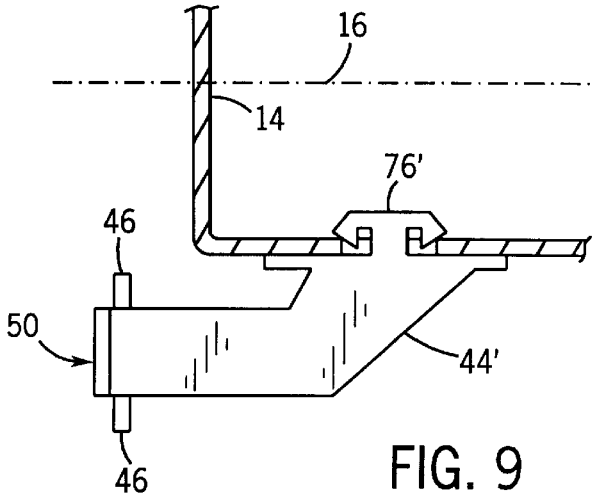
FIG. 9 is a figure similar to that of FIG. 8 showing an alternative embodiment of the actuator extending from the side of the lid.

Referring to FIG. 9, in an alternative embodiment on a side-opening lid, the actuator arm 44' may extend from the rear of the lid 14, at an angle using a similar wedge-shaped plug 76'. Here the access channel 24 shown in FIG. 2 and the slot 26 must be displaced appropriately as will be understood from the foregoing description to those of ordinary skill in the art.

Figure 10:
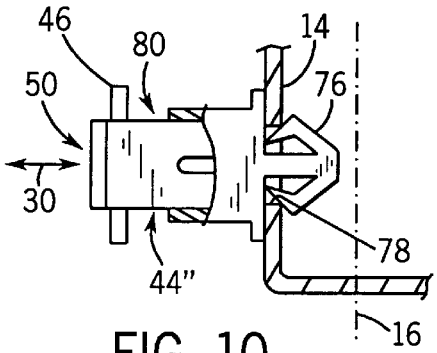
FIG. 10 is a figure similar to that of FIG. 8 showing an alternative configuration of the actuator providing for telescoping movement.

Referring now to FIG. 10, it will be understood that as an alternative or in addition to allowing the switch assembly 28 to slide along the actuation direction 30, that the actuator arm 44" may include a telescoping joint 80 in which actuator arm 44" may move in and out with respect to the lid 14 along actuation direction 30. In this case, the switch assembly 28 may be fixed in position preventing movement.

The above description has been that of a preferred embodiment of the invention. It will occur to those that practice the art that many modifications may be made without departing from the spirit and scope of the invention. For example, the sense of the contacts in the switch may easily be reversed to close with an opening of the lid and hence actuation as used herein should be broadly construed to include opening or closing of switch contacts. In order to apprise the public of the various embodiments that may fall within the scope of the invention, the following claims are made.

We claim:

1. A switch for a laundry machine having a lid moving between an open and closed position with respect to a housing, the switch comprising:

a switch assembly supported by the housing and including a pair of electrical contacts for actuation by an operator moving along an actuation direction;

an actuator communicating with the lid to move therewith, the actuator having an actuating surface pressing the operator inward in the actuation direction when the lid moves from an open to a closed position to actuate the pair of electrical contracts;

wherein at least one of the switch assembly and the actuator is mounted for movement along the actuation direction with respect to the housing and the lid, respectively;

wherein the switch assembly and the actuator include engaging alignment surfaces adjusting a relative position of the switch assembly and the actuator along the actuation direction prior to actuation of the operator by the actuating surface.

2. The switch as recited in claim 1 wherein the switch assembly includes tabs engaging edges of a slot extending along the actuation direction in the housing, the slot being oversized along the actuation direction to allow sliding of the switch assembly with respect to the housing along the actuation direction.

3. The switch as recited in claim 1 wherein the actuator includes a telescoping joint permitting extension and retraction of the actuator with respect to the lid along the actuation direction.

4. The switch assembly of claim 1 wherein the actuating surface and an alignment surface of the switch assembly are outwardly opposed.

5. The switch as recited in claim 1 wherein the lid pivots about an axis and wherein the alignment surfaces on the switch assembly include at least one circumferentially extending finger engaging at least one axially extending pin on the actuator.

6. The switch as recited in claim 5 wherein the alignment surfaces on the switch are at least two circumferentially extending fingers separated radially to receive the pin therebetween;

whereby adjustment of the relative position of the switch assembly and the actuator along the actuation direction prior to actuation of the operator by the actuating surface may occur in inward and outward actuation directions.

7. The switch as recited in claim 5 wherein the actuating surface extends radially outward from the actuator to engage a radially inward operator.

8. The switch as recited in claim 5 wherein the switch assembly includes tabs engaging edges of a slot in a top surface of the housing and wherein fingers extend downward from a portion of the switch assembly abutting an underside of the top surface of the housing when the switch assembly is in position in the slot.

* * * * *